US007390035B2

(12) United States Patent
Karcz et al.

(10) Patent No.: US 7,390,035 B2
(45) Date of Patent: Jun. 24, 2008

(54) SELF-LATCHING MAGNETIC LATCHING DEVICE

(75) Inventors: Irek Karcz, Cromer (AU); Anthony John Clark, Cremorne (AU)

(73) Assignee: D&D Group Pty Limited (AU)

( * ) Notice: Subject to any disclaimer, the term of this patent is extended or adjusted under 35 U.S.C. 154(b) by 0 days.

(21) Appl. No.: 11/034,487

(22) Filed: Jan. 13, 2005

(65) Prior Publication Data

US 2005/0184532 A1 Aug. 25, 2005

(30) Foreign Application Priority Data

Feb. 24, 2004 (AU) ..... 2004900908

(51) Int. Cl.
*E05C 1/08* (2006.01)
*E05C 17/56* (2006.01)

(52) U.S. Cl. ..... 292/163; 292/251.5; 70/224

(58) Field of Classification Search ..... 292/163, 292/165, 169, 229, 177–180, 182, 251.5; 70/210, 215, 224, 276
See application file for complete search history.

(56) References Cited

U.S. PATENT DOCUMENTS 2,219,186 A * 10/1940 Hornfeck ..... 292/144
2,370,691 A * 3/1945 Schlage ..... 292/37
2,514,927 A * 7/1950 Bernhard ..... 292/251.5
2,586,900 A * 2/1952 Alderman ..... 292/74
2,615,744 A * 10/1952 Colonna ..... 292/169.21
2,726,891 A * 12/1955 Gresham et al. ..... 292/337
2,797,655 A * 7/1957 Morehouse ..... 109/63.5
2,988,389 A * 6/1961 Wilson ..... 292/165
3,273,925 A * 9/1966 Graham ..... 292/201
3,334,936 A * 8/1967 Wilhelmus et al. ..... 292/251.5
3,350,127 A * 10/1967 Maarten ..... 292/251.5
3,516,701 A * 6/1970 Graham ..... 292/144

(Continued)

FOREIGN PATENT DOCUMENTS

JP 3212589 * 9/1991

(Continued)

*Primary Examiner*—Carlos Lugo
(74) *Attorney, Agent, or Firm*—Gary M. Anderson; Fulwider Patton LLP

(57) ABSTRACT

A magnetic self-latching device for a gate has a main body with handles on either side for operation or has an arrangement to be remotely actuated, for example electrically. A latching body has a high strength magnet usually provided at the bottom of a cavity which defines a latching shoulder. The latching body is adapted to be fixed to a gate post. The main body, with its housing, can be mounted on the gate frame and incorporates a latch pin which, in the door-closed position, is displaced by magnetic attraction to an extended latching position and against the biasing of a return spring. The gate cannot be opened until actuation of the mechanism occurs, for example by rotating a handle to retract the pin against the magnetic force; the gate can then be swung open. When the handle is released, the biasing spring retains the latch pin in a retracted position. A lost motion arrangement is provided so that there is substantially no load on the pin when the handles are released and the pin is supported in the retracted position by the return spring. A carriage and an associated actuator or a flexible/semi flexible line connection is provided in the housing for incorporating the lost motion arrangement.

11 Claims, 17 Drawing Sheets

U.S. PATENT DOCUMENTS 4,118,055 A * 10/1978 Bischoff, Jr. ..... 292/165
5,029,912 A * 7/1991 Gotanda ..... 292/143
5,362,116 A * 11/1994 Doyle et al. ..... 292/144
5,876,073 A * 3/1999 Geringer et al. ..... 292/144
6,174,005 B1 * 1/2001 Norton ..... 292/169.21
6,733,049 B2 * 5/2004 Piorkowski et al. ..... 292/139
7,044,511 B2 * 5/2006 Kliefoth et al. ..... 292/251.5
2007/0007773 A1 * 1/2007 Berkseth et al. ..... 292/169

FOREIGN PATENT DOCUMENTS

JP 8210001 * 8/1996
WO WO 9203631 * 3/1992

* cited by examiner

SELF-LATCHING MAGNETIC LATCHING DEVICE

FIELD OF THE INVENTION

The present invention relates to magnetic latches suitable for use on gates or doors where automatic latching is required when the gate or door is displaced to a position at which it is to be latched. An actuator is provided for unlatching so that the gate or door can be opened, usually pivotally, away from its latching position.

The present invention in various embodiments offers new and useful alternatives to previously available options and indeed lends itself to embodiments which may incorporate security locks such as quality cylinder locks.

BACKGROUND OF THE INVENTION

A significant development in magnetic latching and devices is the subject of the PCT International Publication WO92/03631 on the basis of which U.S. Pat. No. 5,362,116 was issued to David Doyle and Neil Dunne. This invention has been assigned to the assignees of the present invention. The Doyle and Dunne invention relates to a vertically operating magnetic latch particularly for a swimming pool gate with a lost motion arrangement so that a latching pin, after manual retraction and after opening the gate, is retained in an elevated retracted position by spring biasing and the actuating mechanism does not apply downward load-imposing forces against the biasing spring.

While this device has been successfully exploited, the present invention has been conceived to offer novel inventive and alternative embodiments for different applications in a different form. Indeed the present invention may be applied to provide magnetic latching as an alternative to conventional striker plates with spring door latches and the invention may lend itself to versions incorporating locks.

Embodiments of the present invention are envisaged as extending both to manually actuatable versions (such as embodiments having rotatable rotary knobs or rotatable handles) but also extends to actuation by other means such as solenoids or electric motors permits actuation from a remote location. Of particular significance in these embodiments is the inherent characteristics of magnetic latching as demonstrated by the Doyle and Dunne prior patent whereby when a gate or door is swung to its closed position, in contrast to conventional gate latches where force is required to displace a spring biased latch pin initially away from a latching position prior to it entering into latching engagement, with Doyle and Dunne there is no such resistance. This is especially valuable in installations having an automatic door closing device.

SUMMARY OF THE INVENTION

The present invention is embodied in a self-latching device for latching, in a predetermined position, two members which are otherwise moveable relative to one another, the device comprising a latch arm and a retaining element which in use provides a latching shoulder for the latch arm to prevent relative movement of the members, at least one of the latch arm and the retaining element providing a magnetic field and the other having magnetic properties, the latch arm being arranged to be displaceably mounted on a first of said members and the retaining element being arranged to be associated with the second of said members, the latch arm and retaining element undergoing relative movement into a latching position under the influence of the magnetic field when the members are in the predetermined position, and then relative movement of the two members is substantially prevented by an engagement portion of the latch arm and latching shoulder interengaging, and the latch arm being displaceable under applied force away from the retaining element to a retracted position so that the members may be moved apart, the device further comprises:

(a) a resilient biasing element associated with the latch arm to bias it towards the retracted position, but with a biasing force on the latch arm which is less than the force imparted on the latch arm by the magnetic field when the members are located in the predetermined position;

(b) an actuator movably mounted on the housing and extending from the housing transversely to the path of displacement of the latch portion for receiving a displacement force to displace the latch arm from its latching position to its retracted position, whereby the two members may be moved apart away from the predetermined position;

(c) a connector for connecting the actuator and the latch arm to displace the latch arm from its latching position to its retracted position and to leave the actuator free to move relative to the connector; and (d) a second biasing element for returning the actuator to its initial position on removal of the displacement force leaving the biasing element to maintain the latch arm and connector substantially in its retracted position, whereby when in the predetermined position the latch arm is displaceable under the magnetic forces against the biasing means to re-establish its latching position.

Implementation of the invention may be by including a lost motion interconnection between the actuator and the latch arm whereby no significant load is applied to the latching arm and its biasing element when in the retracted position.

In the subject invention, the actuator may be designed so as to be movable in a rectilinear, arcuate or rotary manner either in or transverse to a plane in which the latch arm is to be displaced.

A particular embodiment is one wherein the latch arm is mounted for reciprocation in a housing and the housing also mounts the actuator in the form of a rotary actuator which may include a conventional rotatable handle, with the option of providing one handle on either side of the device, for example to be disposed on either sides of a gate. Each handle might incorporate a locking mechanism such as a wafer lock or cylinder lock for security reasons. The housing might incorporate an alternative locking mechanism.

One embodiment provides a carriage with spaced guides along which mounting elements of the latch arm can slide, the latch arm incorporating a pin around which a helical compression biasing spring is mounted as the biasing means. In such an embodiment a torsion spring can be provided as the restoring means for the rotary actuating means (such as the handles).

As described with reference to an illustrated embodiment, the latch arm can take the form of a generally C-shaped carriage which moves in guides in the housing and the C-shaped carriage has lobes at its open ends for engagement with corresponding projecting elements associated with a barrel connected to a rotatable handle.

An alternative approach, however, is to provide the latch arm with a drum-like structure around which a flexible connection element extends. The arrangement is such that the element is extended and perhaps tensioned when the latch arm is in the latching position and rotation of the drum by the actuator causes the latch arm to be retracted. The arrangement is such that after movement of a gate (or door) to an open position, the biasing means retains the latch arm in its retracted position and tension previously applied to the flexible element is relieved so that no or only negligible load is applied against the biasing means.

The device may include an actuator for displacing the latch arm by remote actuation for remote gate opening control. However, larger markets are thought to be for directly operated gate latches having handles.

Embodiments of the invention can be formed into a volume, shape and configuration consistent with conventional cylinder lock door locks, i.e. within an envelope of about 15 cm×10 cm×5 cm.

Embodiments may have the magnet material provided by a permanent magnet having a remanence (residual flux density) of about 12 kilogauss and the latch arm has a pin having magnetic properties and of transverse dimension of about 8 mm, preferably sealed within the body of the retaining element and the latch arm then has a steel pin providing the latching portion and of a suitable grade of steel having magnetic properties.

In place of a rotatable knob or rotatable handle for actuating means, the invention lends itself to embodiments which are remotely actuated, for example electrically by the use of a solenoid arrangement or motor to cause rotation of the actuator for retraction of the latching arm.

Generally arrangements incorporate a lost motion interconnection between the actuator and the latch arm such that little or preferably no load is applied to the latching arm and its biasing means when in the retracted position.

Although significant markets for embodiments of the invention are perceived to be for gate locks incorporating key actuated mechanisms such as wafer locks or cylinder locks, embodiments may be simply no-lock latch mechanisms, or embodiments having an egress button on one handle and a lock on the other.

Embodiments can provide a lost motion effect by having an eccentric drive pin to be displaced upon lock actuation to displace an internal element from a retracted position (where it rotates freely upon handle rotation) to an extended position in which it engages with a collar to rotate the collar and the collar in turn displaces a carriage to retract the latch arm.

The term "comprising" (and its grammatical variations) as used herein are used in the inclusive sense of "having" or "including" and not in the sense of "consisting only of." Other features and advantages of the invention will become apparent from the following detailed description, taken in conjunction with the accompanying drawings which illustrate, by way of example, the features of the invention.

BRIEF DESCRIPTION OF THE DRAWINGS

The invention will be further exemplified with reference to the accompanying drawings of which.

DETAILED DESCRIPTION OF THE INVENTION

Figure 1A:
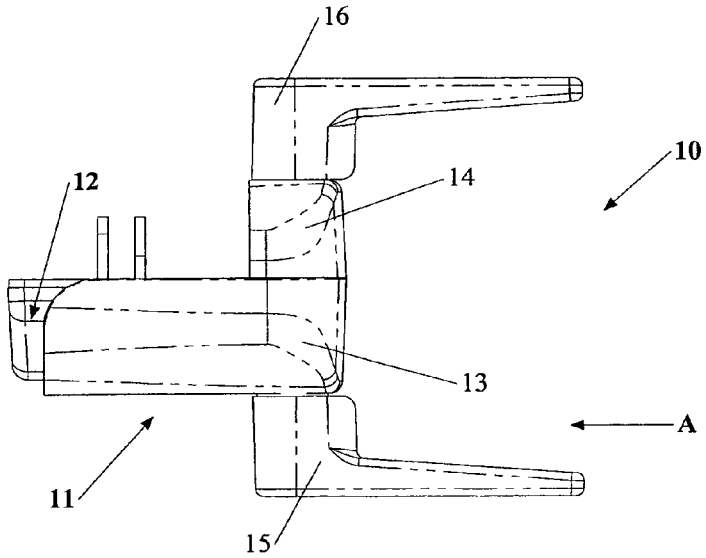
FIGS. 1A, 1B and 1C are respectively a plan view, a front elevation and an end elevation (in the direction of arrow A in FIG. 1A) of an embodiment of the invention suitable for fitting to a gate.
Figure 1B:
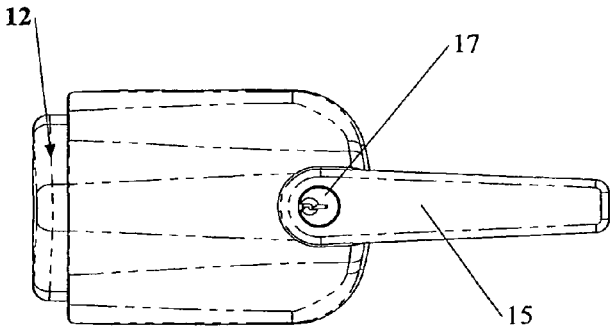
Figure 1C:
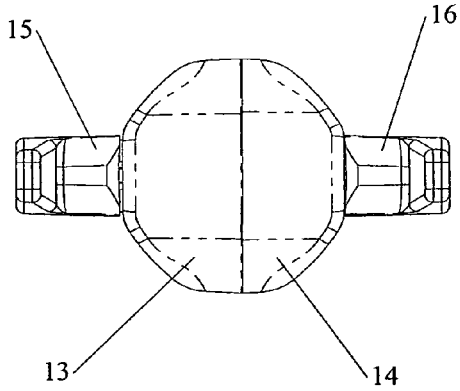

The gate latch generally shown in FIGS. 1A to 1C is shown in assembled form and prior to installation. The latch 10 comprises a lockable latch module 11 to be mounted on a post of a gate and a receiving latch block 12 which is adapted to be mounted to a fixed gate post.

The latch module has a front casing 13 and a rear casing 14 adapted to be mounted on opposite sides of gate post. Front and rear handles 15 and 16 are provided and a security cylinder lock 17 is provided for each handle for independent locking purposes.

Figure 2:
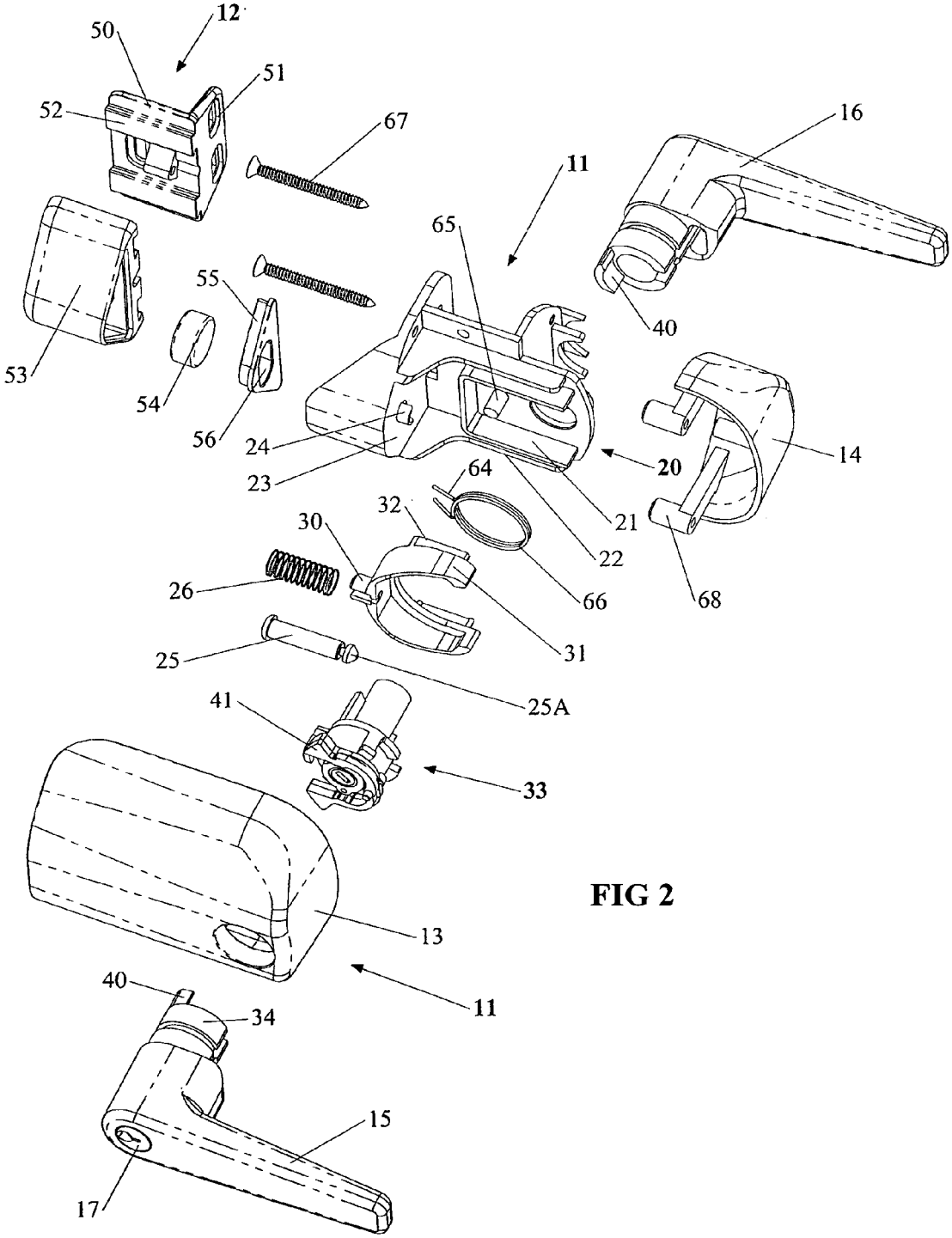
FIG. 2 is an exploded view of the device of the embodiment of FIGS. 1A to 1C.

The components are shown in more detail in FIG. 2. A mounting structure 20 is provided for attachment to a gate post of rectangular cross-section and to mount the components within the casings 13 and 14 and to mount the handles 15 and 16. The mounting structure 20 includes a back plate 21 having spaced parallel grooves 22 to guide a latch pin assembly, and an integral end wall 23 having a small collar 24 around an aperture (not shown) through which a latching pin 25 can move. A helical compression spring 26 is mounted on the latching pin and the right hand end of the latching pin 25 upon assembly is attached by engagement in a cylindrical projection 30 of a generally C-shaped carriage 31. The carriage 31 has integral parallel guide strips 32 extending from its rear face provided for sliding engagement in the grooves 22 in the back plate 21.

An actuating barrel 33 (as shown in more detail in FIGS. 3 and 4) is to be rotated by the handles and displace the carriage axially relative to the latching pin 25. The barrel engages with an end portion 34 of a front handle 15 after the end portion is assembled by passing through an aperture in the front casing 13. An arcuate tab 40 projects from the end portion 34 to engage a slot in the barrel 33 so as to transmit rotation. The barrel 33 extends through an aperture in the back plate 21 to be connected to an end portion 35 of the rear handle 16. An arcuate tab 40 also engages with a slot on the rear of the barrel 33 to transmit rotation.

Figure 3:
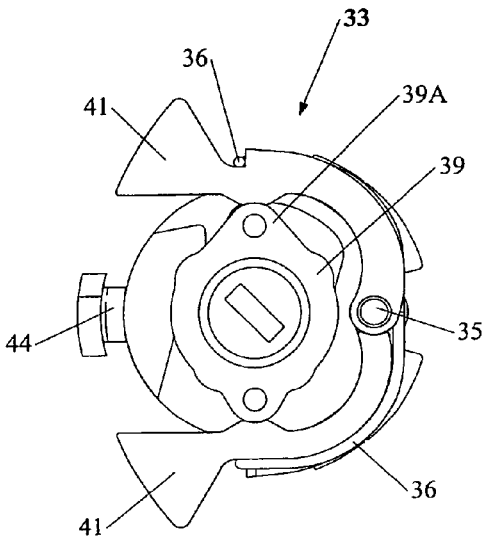
FIG. 3 is an end view of an actuating barrel of the device on an enlarged scale.

As best seen in FIG. 3, the actuating barrel 33 has a rectangular shaped through-aperture 38 for receiving a conventional actuating bar which extends from the rear of a cylinder lock 17. The barrel has a structure which permits rotation of the barrel only when the key has been turned to unlock the lock 17, as now described with reference to FIGS. 3 and 4.

The rear end of the barrel 33 has a groove 33B for accommodating the corresponding arcuate tab 40 from the rear handle so that rotary motion is transmitted to the barrel 33 when the latch is assembled and either handle is rotated. A similar groove 39A is provided on the front of the barrel for the arcuate tab 40 of the front handle. The barrel assembly includes upper and lower ears 41 at the ends of pivotal arms 34 which are mounted on pivot pin 35 with a C-shaped spring clip 36 fitted over the arms 34 to bias them radially inwardly so that recess 37 in the inner periphery of each arm rest on lobes 39A of a rotor 39. The recess provides a detent function to define positively the position shown.

Figure 4:
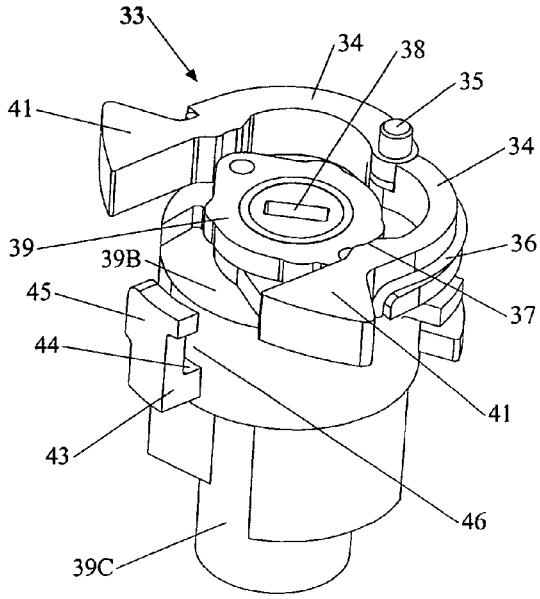
FIG. 4 is an isometric view of the actuating barrel on an enlarged scale.
Figure 7:
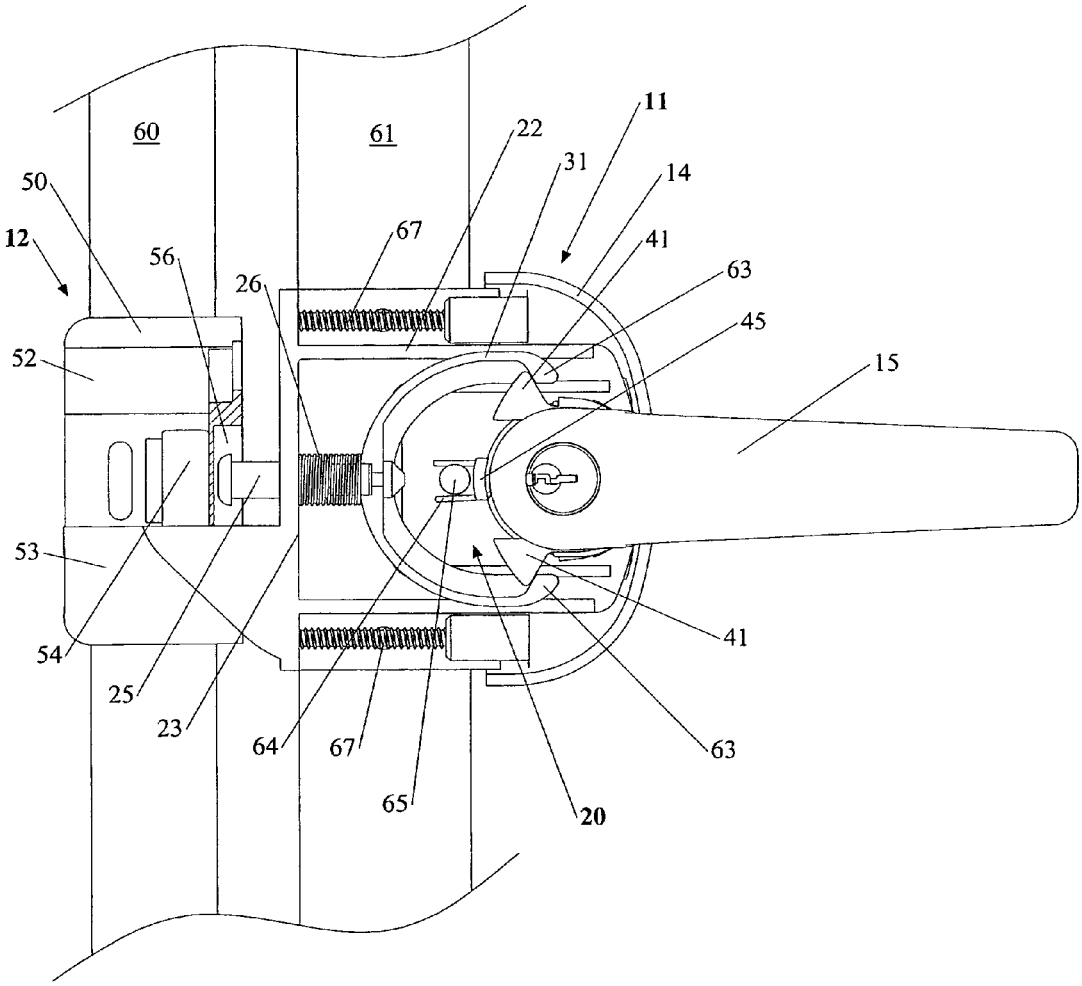
FIG. 7 is an elevation with the front housing removed and showing the latching configuration with a latch pin of the latch arm extended into latching engagement in a cavity of a latch block.

A middle portion of the barrel has an L-shaped bracket 43 for retaining end pins 64 of a torsion spring 66 (not shown in FIGS. 3 and 4 but shown in FIGS. 2 and 7). The L-shaped bracket has a mounting leg 44 and an arcuate base 45 with a groove 46 for accommodating the body of the torsion spring 66.

Figure 5:
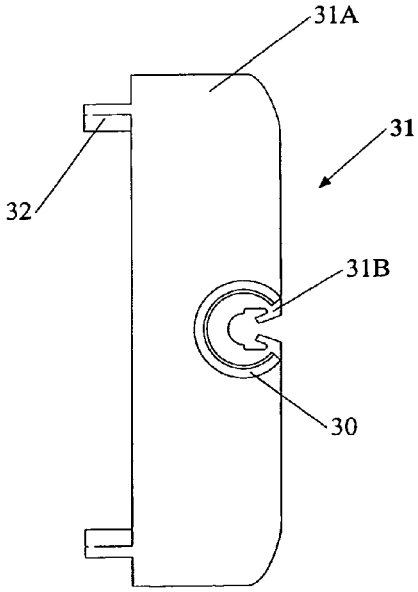
FIG. 5 is an end elevation of a sliding carriage of the latch arm on an enlarged scale.
Figure 6:
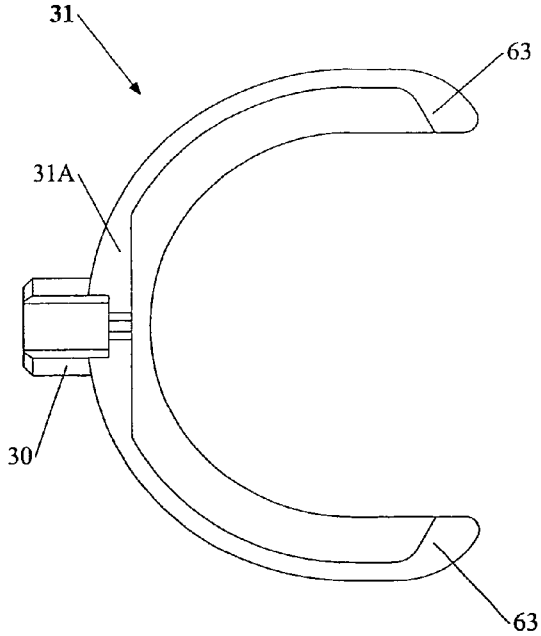
FIG. 6 is an elevation of the sliding carriage of FIG. 5.

FIGS. 5 and 6 show detail of the carriage 31 which has a central wall 31 A and the part cylindrical projection 30 accommodating a spring locking tag 31B into which a groove 25A near the rear of latching pin 25 is snap-fitted. The carriage 31 has inwardly directed lobes 63 for receiving a displacement force when either is engaged by an ear 41 of an arm 42 as described below.

Figure 8:
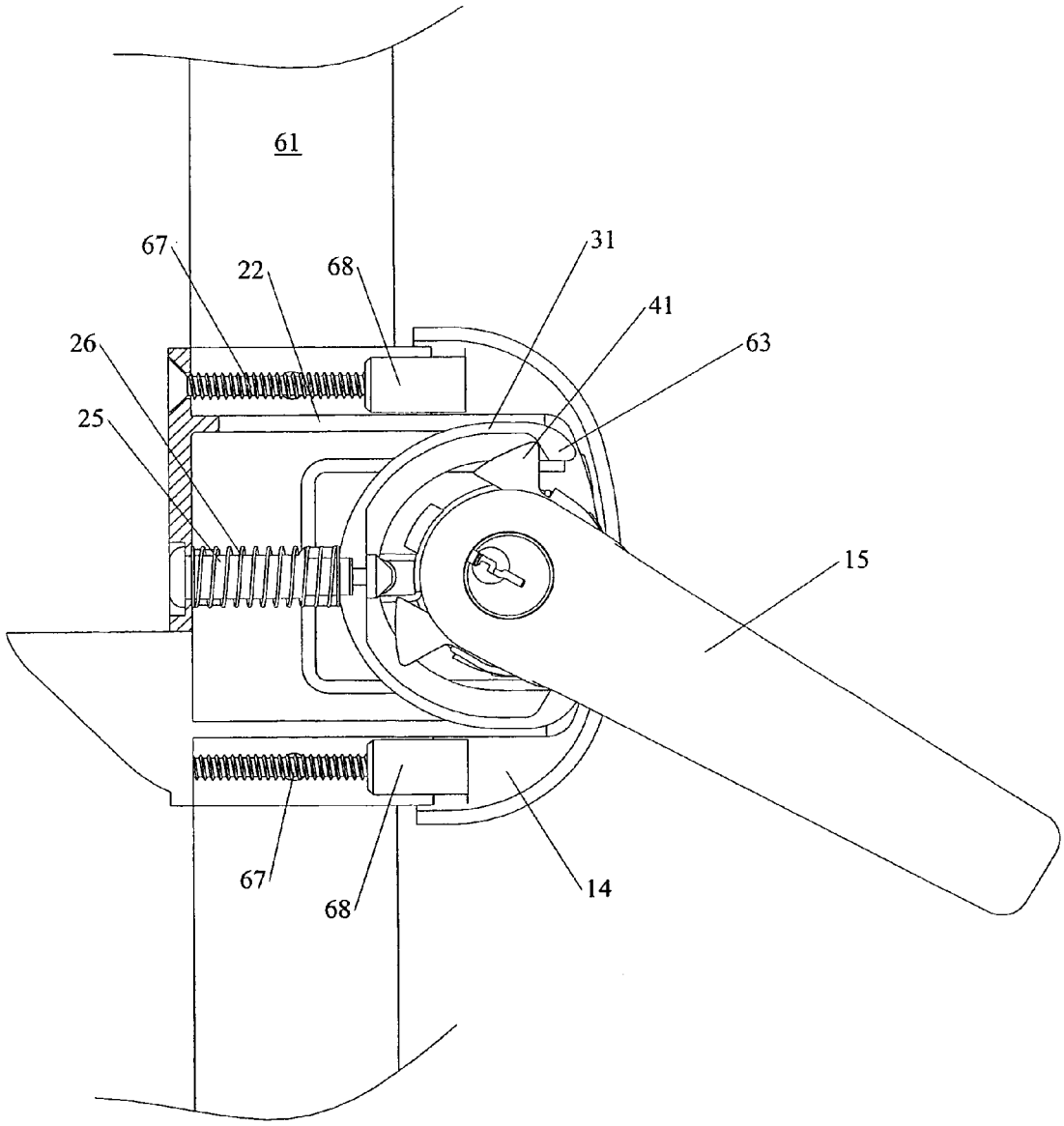
FIG. 8 corresponds to FIG. 7 but after rotation of an actuating handle to retract the latch pin to permit the associated gate to be swung open.

FIG. 3 shows the configuration when the lock 17 has been unlocked so that the ears 41 project and upon rotation of the handle, as shown in FIG. 8, upper ear 63 is engaged and the carriage moved rectilinearly to the right.

Referring now to FIG. 7, the latching block 12 is shown mounted to a fixed gate post 60 and the latching module I1 is shown mounted to an end post 61 of a gate. The latching block 12 is shown in part-sectional view and the latching module is shown with the front casing removed for clarity. In the configuration shown in FIG. 7, the handles have been released and are arranged horizontally by the effect of a torsion spring 66 (shown in FIG. 2) and mounted on the barrel 33. FIG. 7 shows the device in the predetermined position, i.e. the latching position at which the latch pin 25 has been magnetically attracted to extend so that the tip of the latch pin engages in the aperture 56. The spring 26 is compressed between the interior of the end wall 23 and the carriage 31. The carriage is thus drawn to the left and the lobes 63 of the carriage are adjacent to or engage with the ears 41 of the actuating barrel 33, since in this configuration the lock is unlocked.

However, when the lock is locked, the rotor 39 is rotated and the lobes 39A disengage the arms 34 which displace inwardly under the pressure of the spring clip 36. If the handle 15 is displaced, the ears 41 do not engaged the lobes 63 of the carriage and the carriage does not move.

FIG. 7 also shows the end pins 64 of the torsion spring which engage of a location pin 65 which extends from the back plate 21.

The components of the latching block 12 are more clearly shown in exploded view in FIG. 2.

The components comprise an L-shaped mounting plate 50 adapted to be secured to a post by screws passing through apertures 51 on an end face. The mounting plate has dovetail section tracks 52 for engaging slidingly with complimentary shaped grooves on the rear of a latch body 53. The latch body has a central cavity for accommodating a high strength magnet 54 which is held in position and the cavity sealed with suitable sealant when a cover element 55 is secured in place. The element 55 has a suitable shaped aperture 56 having a latching function when engaged with the tip of latching pin 25.

Main fixing screws 67 (shown more clearly in FIG. 8) extend through the end wall 23 of the mounting structure 20 and into tapped receiving arms 68 of the rear housing 14.

Although not shown in the drawing, the rear of the front housing 11 is provided with spaced mounting lugs having cylindrical bores through which the mounting screws 67 also extend to achieve assembly. FIG. 8 shows downward rotation of the handle 15, typically after manual unlocking and depression of the handle. The actuating barrel 33 retracts the carriage 31 by virtue of engagement of the upper ear 41 with the upper lobe 63 of the carriage thereby displacing it to the right as shown in FIG. 8. The pin 25 is thus retracted to the position shown in FIG. 8 and is removed from engagement with the cavity 56 of the receiving block. The gate can then be swung open and, when the handle is released, because there is no magnetic field influence, the carriage 31 remains in its position under biasing of the spring 26 and leaving the latch pin 25 retracted.

Figure 9:
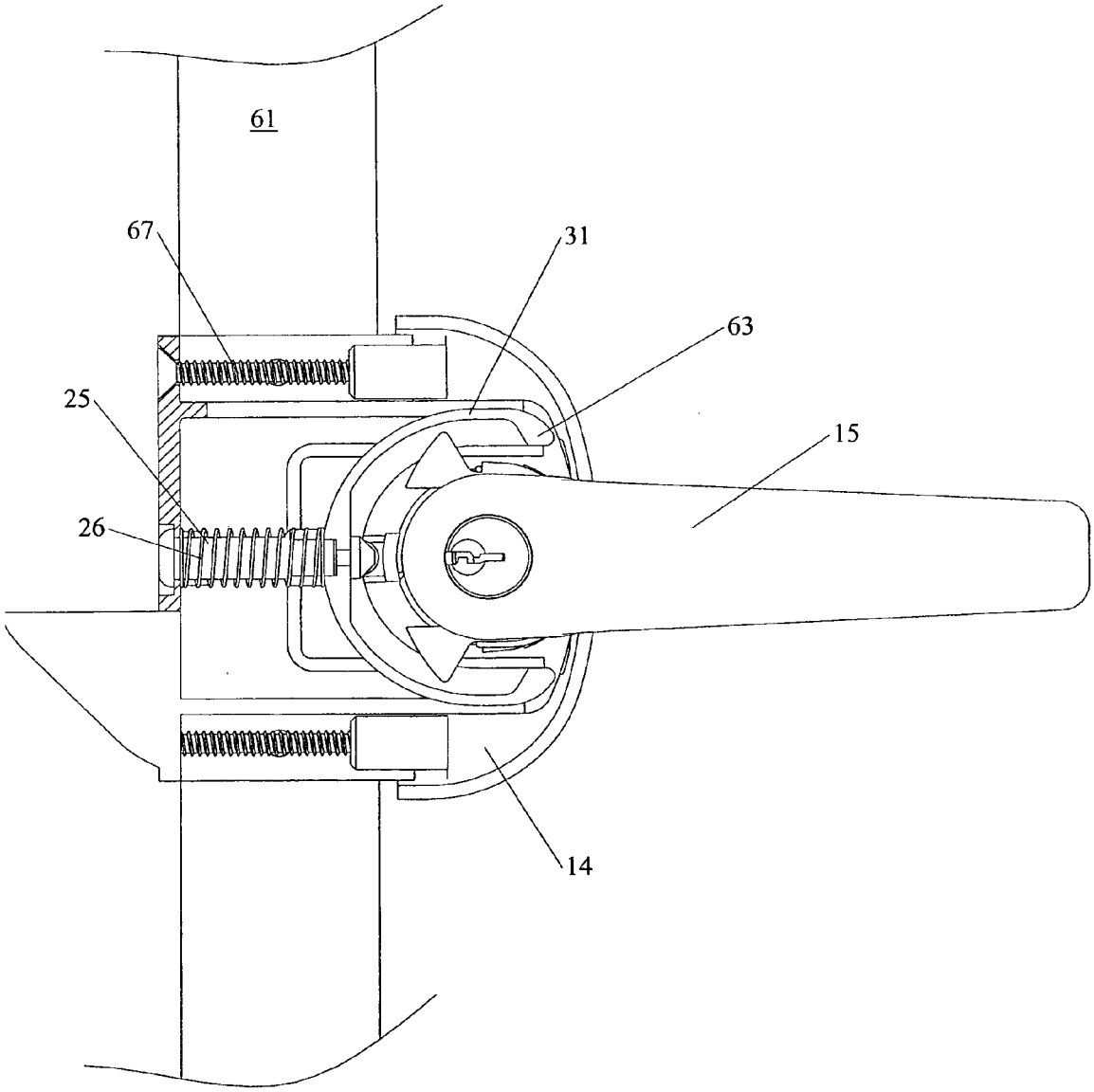
FIG. 9 is a view corresponding to FIG. 8 but after release of the handle to return to its normal position and with the latch pin retained in a retracted position.

FIG. 9 shows the handle returned to its original position under influence of the torsion spring 66 with the carriage 32 in its right hand displaced position.

As and when the gate is returned to its closed position, the latch pin 25 again becomes aligned with the receiving cavity 56 and is then attracted under the strong magnetic field to move to the left thereby compressing the biasing spring 26 and sliding the carriage 32 to the left so that the configuration of FIG. 7 is attained.

Figure 10:
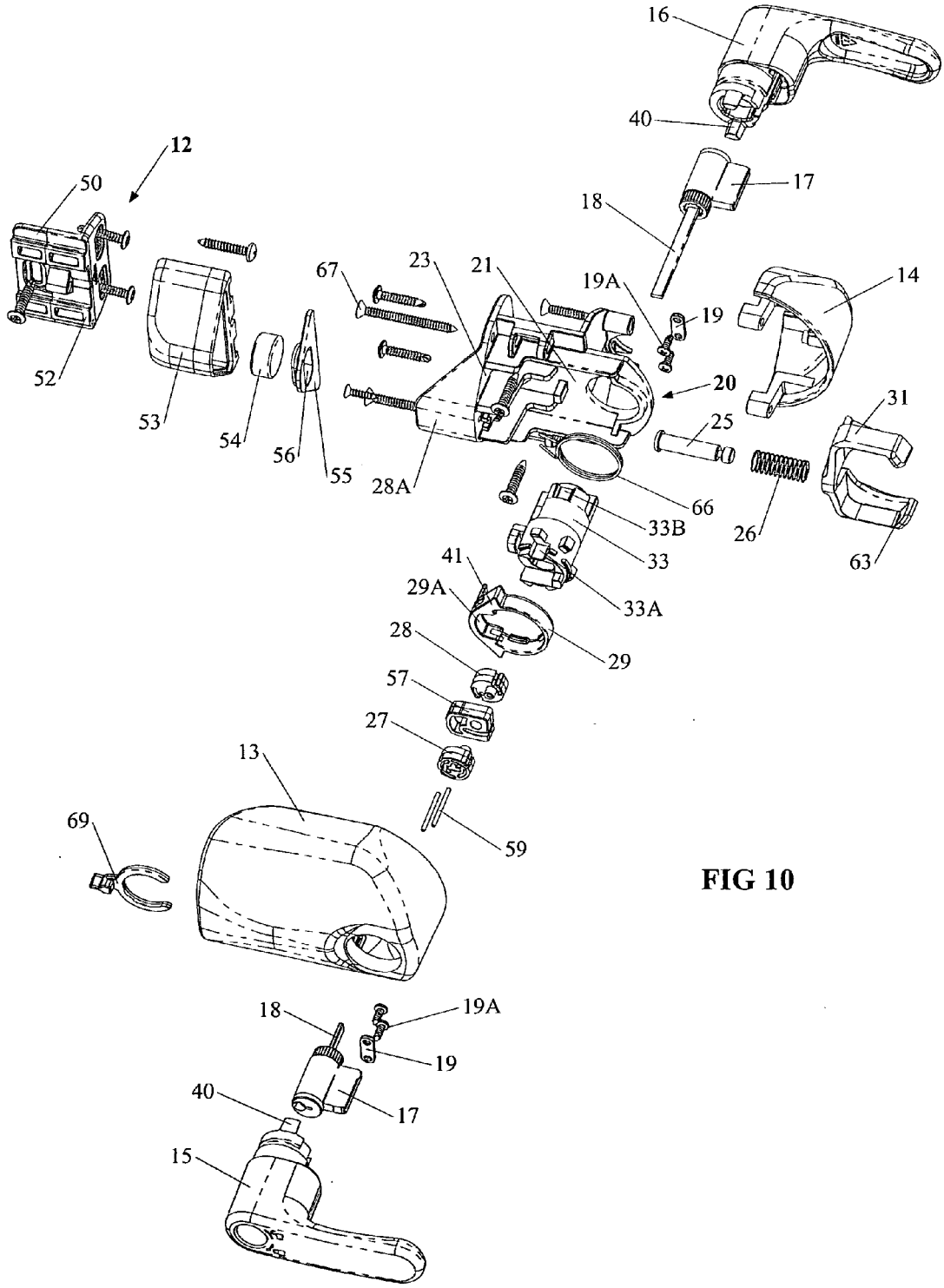
FIG. 10 is a partly exploded isometric view of a second embodiment.

Reference will now be made to FIG. 10 which shows a second embodiment of the disclosure which is similar to but a more practical version of the first embodiment. Like reference numerals have been used for like parts and only differences will be highlighted.

This embodiment shows the detail for mounting a conventional six pin cylinder lock 17 in each handle. The lock is inserted into the handle barrel with a lateral projection from each cylinder engaging in a corresponding cavity. A retaining plate 19 is inserted to close the cavity and secured by fixing screws 19A. Each cylinder lock has a projecting tab 18 being of rectangular cross-sectional shape for conventional purposes and of a length to suit engagement in respective rotor elements 27 and 28 to be associated with the actuating barrel 33 as described in more detail below.

Each handle is secured to the respective casing by a spring clip 69.

In this embodiment, the form of the mounting plate 20 is slightly different form, as illustrated, and the end wall 23 incorporates an integral security housing projection 28.

In this embodiment, the barrel 33, in place of the pivotal spring arms 34 of the first embodiment, has a moulded collar 29. Within the collar is mounted a tongue 57 which is secured in cooperating relationship to the front and rear rotors 27 and 28 which are secured, as described below, by two plain roll pins 59.

FIG. 10 shows in this embodiment that the handles have a pair of arcuate projecting tabs 40 for transmitting rotation. The front handle 40 has its tabs, on assembly, engaged in grooves 66 in a front portion of the barrel 33 whereas the rear handle 16 has its tabs 40 engaged in grooves 67 on the rear of the barrel 33. Thus rotation of either handle will rotate the barrel. However the collar 29 does not rotate unless the tongue 57 has engaged in a recess 29A in the collar. Engagement is achieved by unlocking. Unlocking the front lock turns the rotor 27 by virtue of engagement of the rectangular bar 18 in a central aperture in the rotor and, because of eccentric positioning of the pins 59, the tongue is displaced to the left as shown in FIG. 10 so its leading end engages in the cavity 29A in the collar. Thereafter rotation of the handle causes rotation of the collar 29 and upper or lower ear 41 then engages a lobe 63 of the C-shaped carriage to retract the latching pin.

Figure 11:
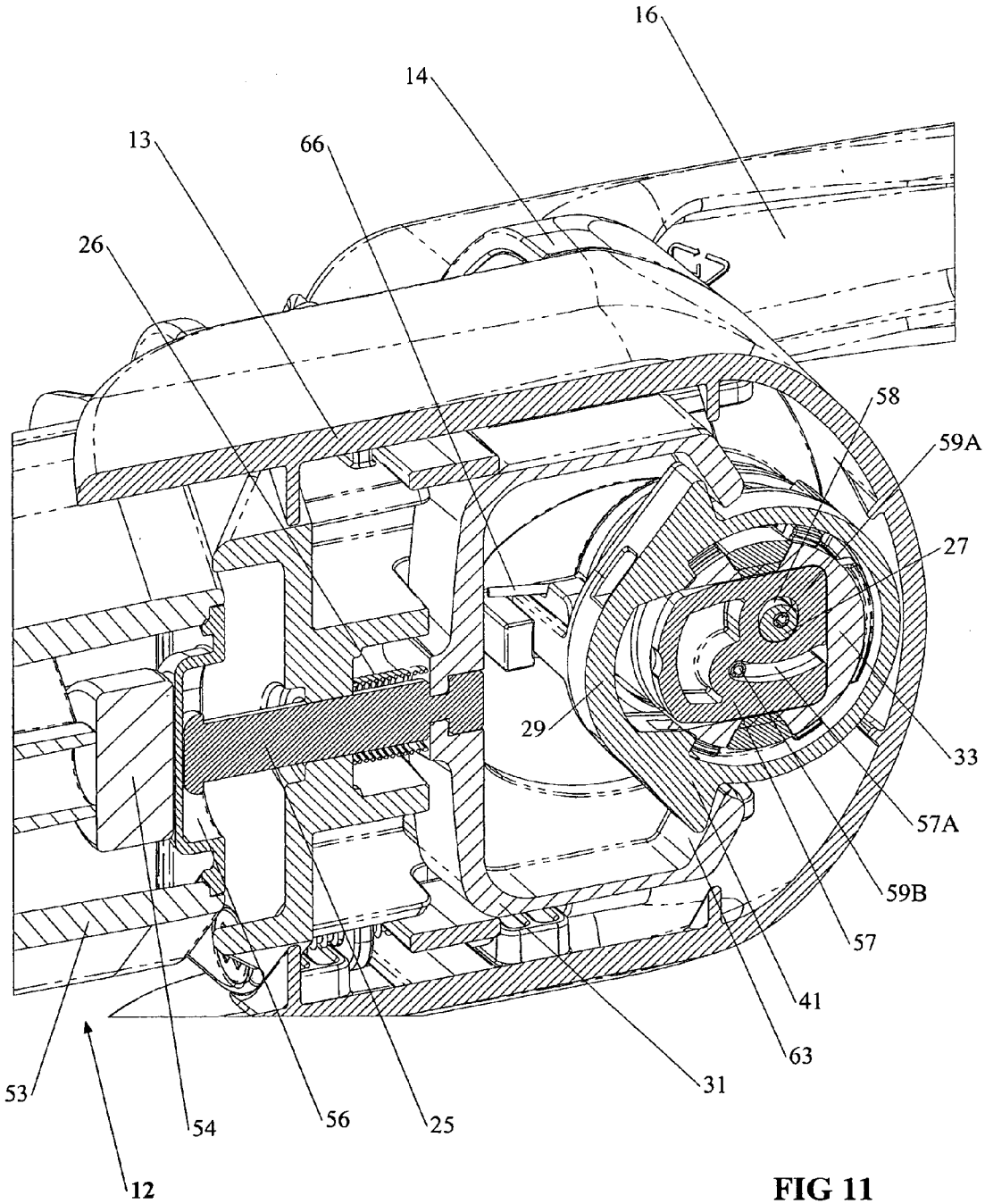
FIG. 11 is an isometric cross-sectional view of the embodiment of FIG. 10 when in the locked configuration and latch pin engaged by magnetic force into the receiving latch block.

Referring now to FIG. 11, which is an oblique view through a vertical central plane of the assembled device in a locked configuration, the configuration of the tongue 57 will be better appreciated. The collar 29 is mounted on and freely rotatable on the barrel 33 with the torsion spring 66, not shown in the drawing, located behind the collar 29. This biases the barrel to its normal or rest position. The tongue 57 has a slightly elongate aperture 58 elongated in the vertical direction and receiving from each side thereof cylindrical projections, each having a through bore, from the respective rotors 27 and 28. A first of the pins 59A is inserted through rotor 27 through its cylindrical projection and into the complimentary cylindrical protection of the rotor 28 lying behind the tongue. The second pin 59B is inserted through an aperture in the rotor 27, through an arcuate slot 57A in the tongue and into a corresponding aperture in the other rotor 28.

The collar 29 is rotatably mounted around the barrel and in the position shown in FIG. 11 the tongue 57 is in a retracted position so that rotation of the barrel and tongue by a handle does not transmit any rotation to the collar 41. The ears 41 lay adjacent the lobes 63 of the carriage. When the key mechanism is actuated to unlock the handle rotation of the rotor 27 occurs and the eccentrically disposed upper roll pin 59 occurs relative to the central pin 59B in an anti-clockwise direction thereby displacing the tongue to the left is shown in FIG. 11. This then causes the leading edge of the tongue to engage in the cavity 29A whereby any rotation of the handle thereafter rotates the barrel, the tongue and the collar thereby retracting the carriage 31 and the latch pin 25.

Figure 12:
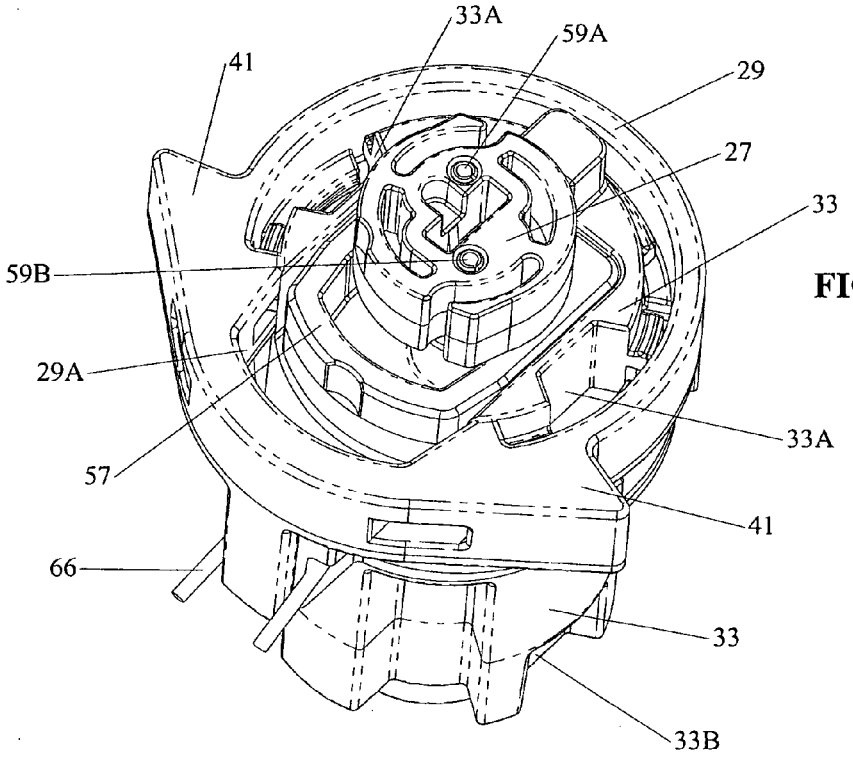
FIG. 12 is an isometric view on an enlarged scale of the rotary actuating a mechanism of the second embodiment shown on an enlarged scale and in a locked configuration.
Figure 13:
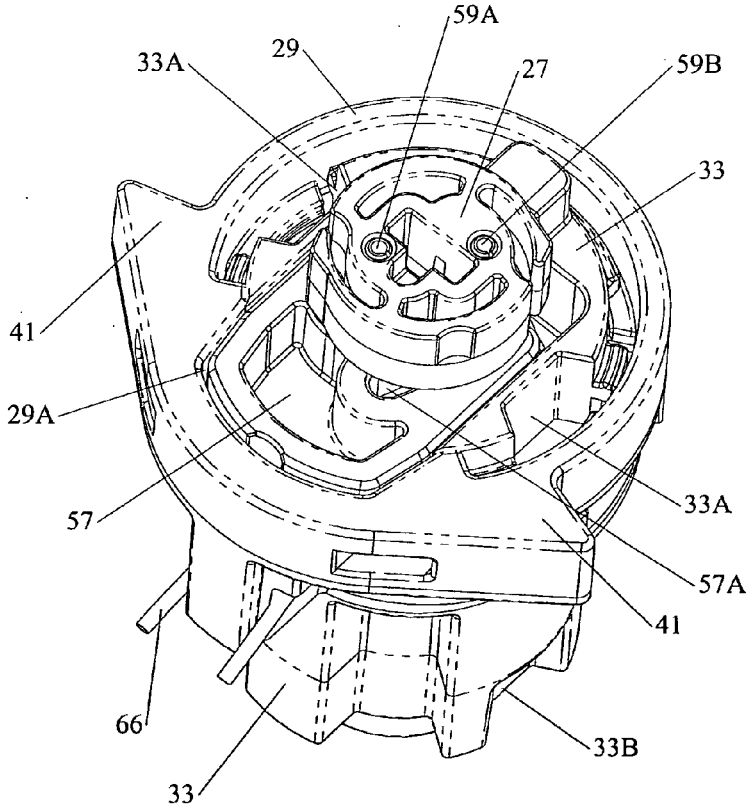
FIG. 13 is a view corresponding to FIG. 12 and showing an unlocked configuration.

FIGS. 12 and 13 show an enlarged scale in isometric view the assembled components in the locked and unlocked configurations.

Figure 14:
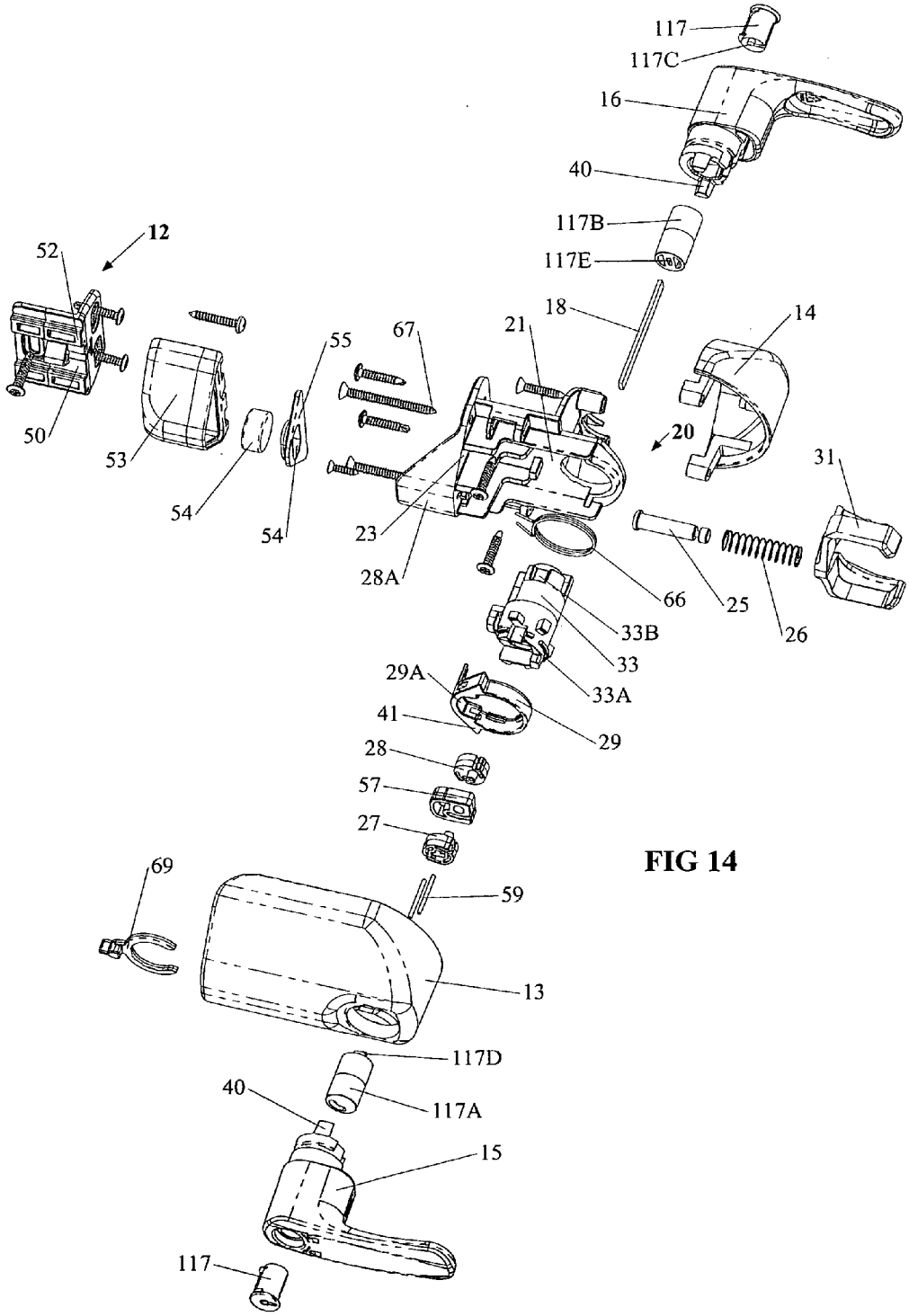
FIG. 14 is an exploded view of a third embodiment.

In place of the cylinder lock shown in FIG. 10 a wafer lock, which is less expensive and simpler, may be used. FIG. 14 is an exploded view of such an embodiment. A cylinder lock has an inherent lost motion effect but a wafer lock does not. Therefore when a wafer lock 117 is used, an adapter barrel 117A or 117B is utilised. Each adapter barrel has an eccentrically disposed arcuate slot facing the end of the wafer lock and accommodating and providing lost-motion for an eccentrically disposed cylindrical projection from the tip 117C on the rear end of the wafer lock (see rear wafer lock 117 in FIG. 14). In the case of the front adapter barrel 117A, it contains a short rectangular bar 117D for engaging in and rotating the front rotor 27 and in the case of the rear adapter barrel 117B there is a rectangular slot 117E in the adapter barrel for accommodating the end of an elongate rectangular drive bar 18 which has the effect of driving the rear rotor 29.

Figure 15:
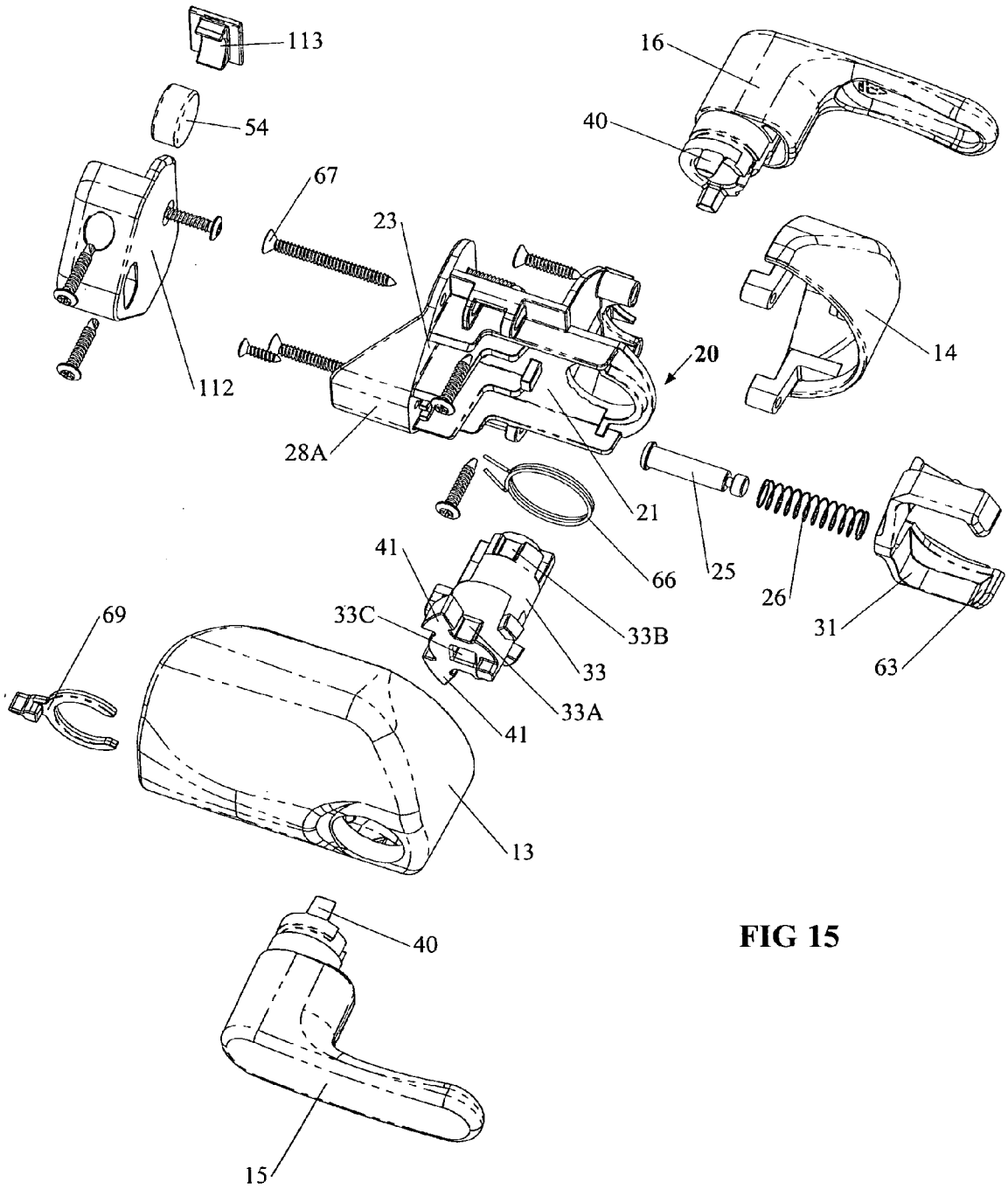
FIG. 15 is an exploded view of a fourth embodiment.

FIG. 15 is an exploded view of a third embodiment being a no-lock version wherein like parts have been given like reference numerals. Equivalent functionality applies without the complexity of locking options. In this embodiment an alternative form of non-adjustable latch block 112 is illustrated incorporating a cavity for the high performance magnet 54 which is retained by a cover plate 113.

The barrel 33 is simplified as an integral moulding incorporating ears 41 and at a forward end region a pair of grooves 33A for engaging with the projecting tabs 40 from the rear of the front handle for rotating the barrel. The rear portion of the barrel has further grooves 33B for similar engagement with the projecting tabs 40 from the rear handle 16. Upon assembly the barrel is located with the ears 41 located behind the lobes 63 of the carriage 31 and the embodiment operates by direct actuation of the carriage.

FIG. 15 also illustrates a square aperture 33C extending through the barrel for accommodating a conventional square drive bar of a rotary door knob which is an alternative to the use of the handles shown.

Figure 16:
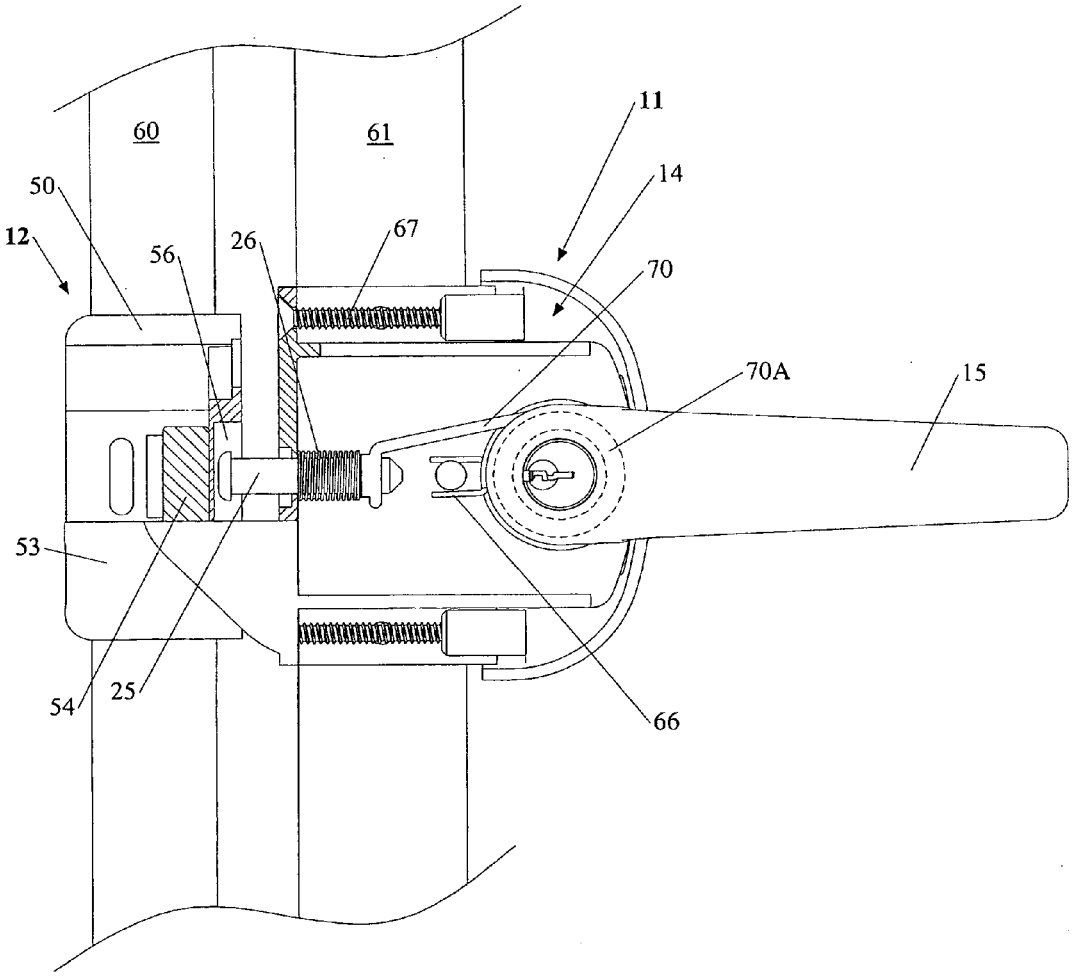
FIG. 16 is a view of a fifth embodiment of the invention utilizing a flexible line to provide a lost motion system.
Figure 17:
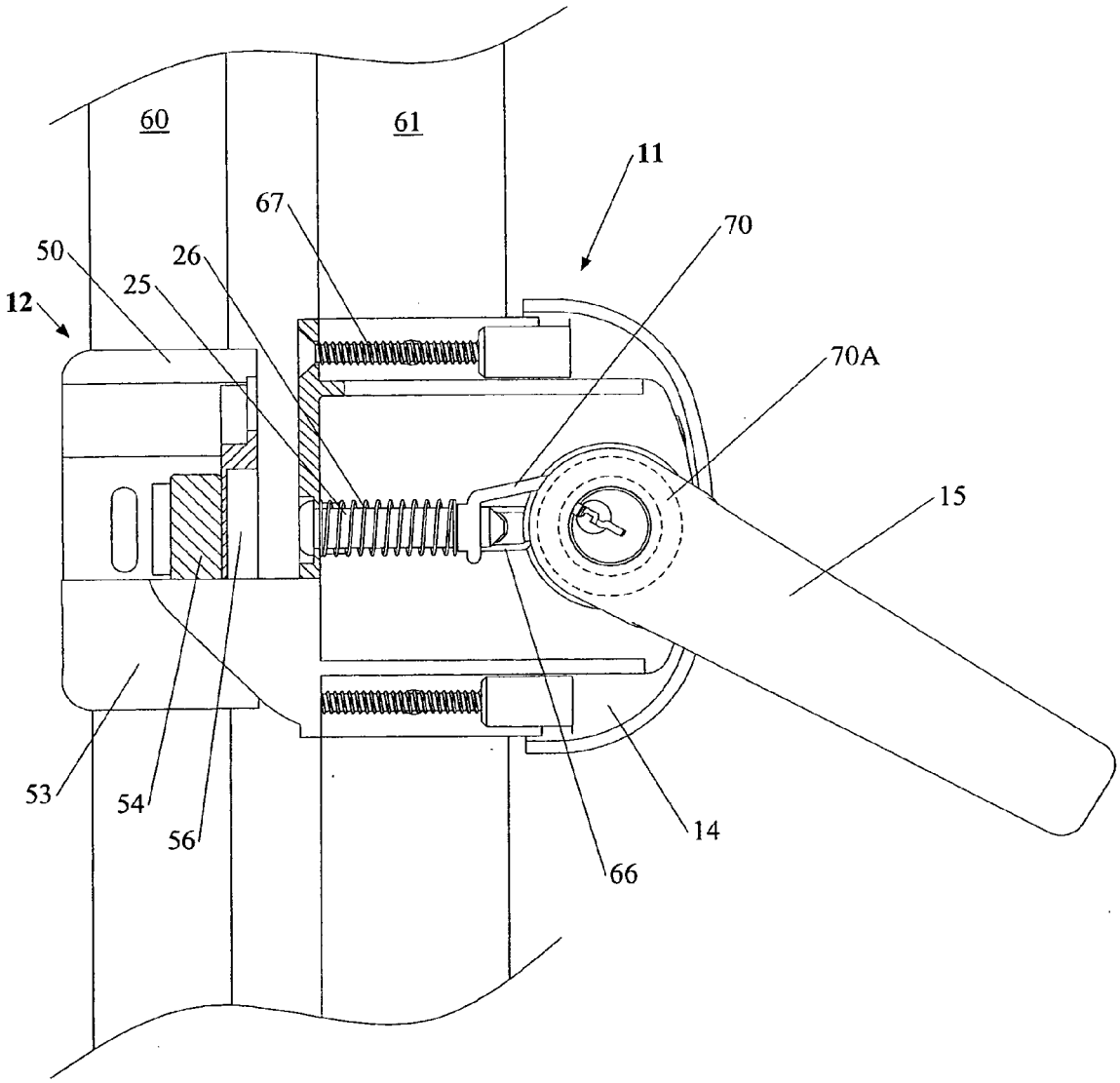
FIG. 17 is a view of the embodiment of FIG. 16 in which the handle has been depressed.
Figure 18:
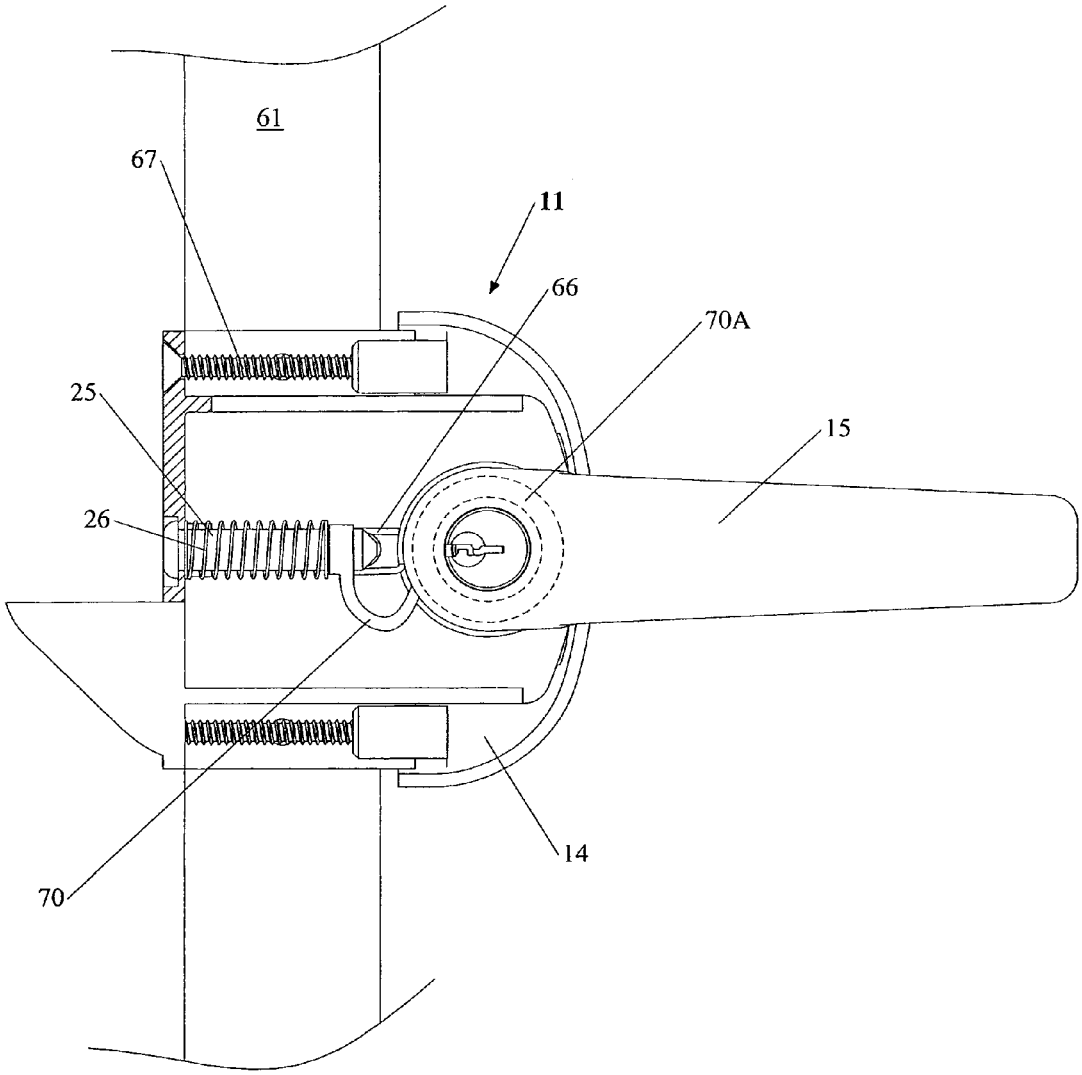
FIG. 18 is a view of the embodiment of FIGS. 16 and 17 in which the handle has returned to its neutral position after depression.

Referring now to the fifth embodiment of FIGS. 16-18, the drawings show an alternative connection system between the locking pin 25 and handle 15 to replace the actuating barrel 33 and the associated upper ear 41 and upper lobe 63 of the first embodiment. In this embodiment, there is provided a drum (not shown) around which is mounted a flexible line 70. The line 70 is connected to a right hand end portion of the pin 25. FIG. 16 shows the device in the same predetermined position as shown in FIG. 7. The locking pin 25 is drawn to the left and the flexible line 70 is drawn off the drum and becomes taut. In this configuration the handles 15 and 16 are released and arranged horizontally by the effect of the torsion spring 66.

Referring now to FIG. 17, downward rotation of the handle 15 has occurred, typically after manual unlocking and depression of the handle 15, causing the flexible line 70 to retract the locking pin 25, displacing it to the right against the force of the magnet 54. The pin 25 is thus retracted to the position shown in FIG. 17 and is removed from engagement with the cavity 56 of the receiving block. The gate can then be swung open, and when the handle is released, there is no magnetic field influence on the locking pin 25. The pin 25 which is biased to the right by the biasing spring 26. FIG. 18 shows the sagging of the flexible line 70 when the handle 15 is released and returns to its original position under the influence of the torsion spring 66.

In a similar way to previous embodiments, when the door or gate is returned to its closed position, the configuration of FIG. 16 is attained once again.

Figure 19:
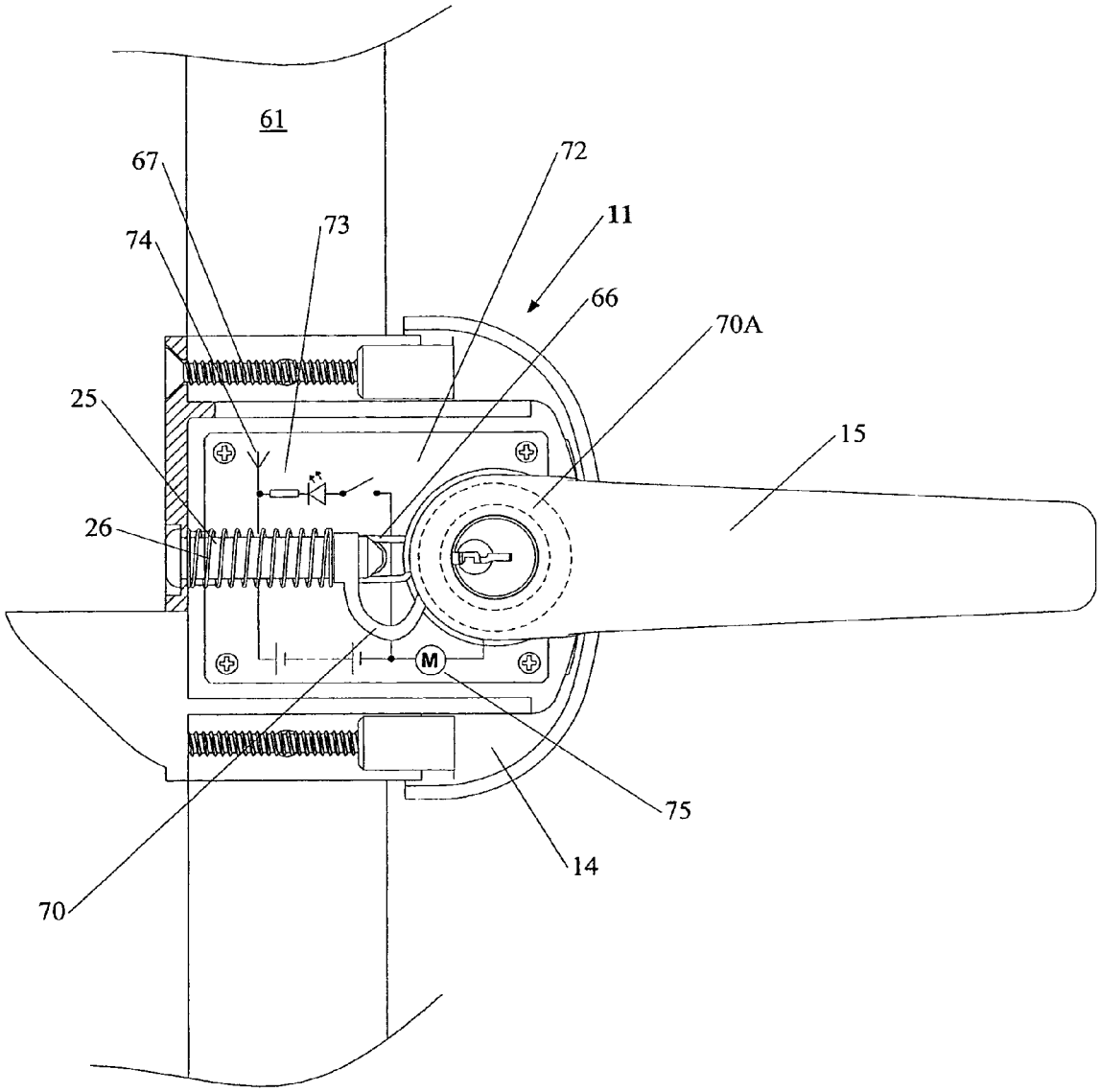
FIG. 19 is a schematic view of the sixth embodiment modified for remote actuation.

Referring now to the adaptation of FIG. 19, the parts are shown schematically with provision for a remote actuator 72 including an electrical actuator 72 having a set of connections 73 when it is to be hardwired to a circuit closing device or an aerial 74 where a wireless signal is to be received and interpreted to actuate the device. The circuit includes a source of electrical power such as a transistor radio battery sufficient to drive either a solenoid or a small motor 75 which drives the drum 70A. Thus remote actuation can occur to remotely actuate the gate lock.

Figure 20:
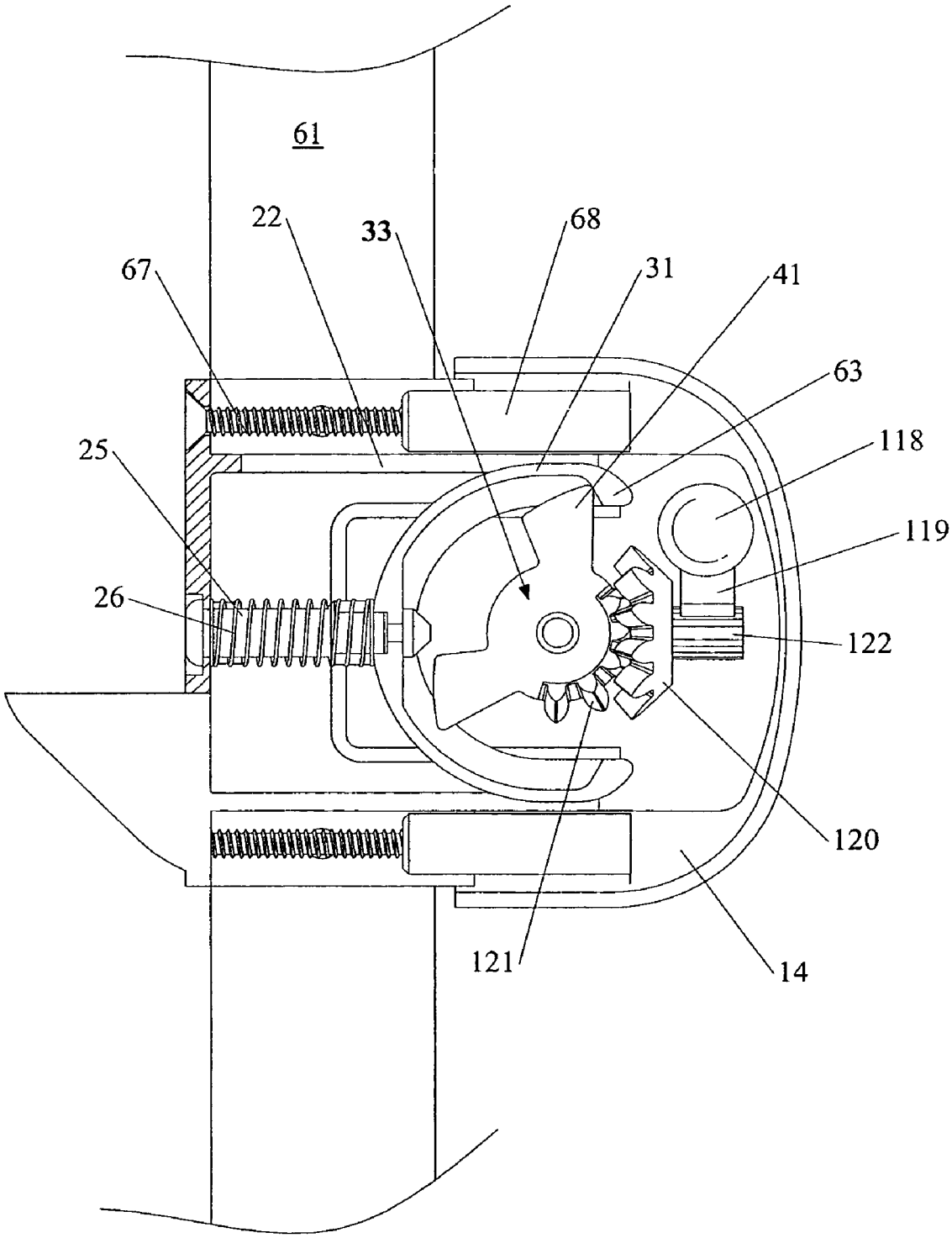
FIG. 20 is a front part-sectional view of a seventh embodiment when actuated to retract a latch pin.
Figure 21:
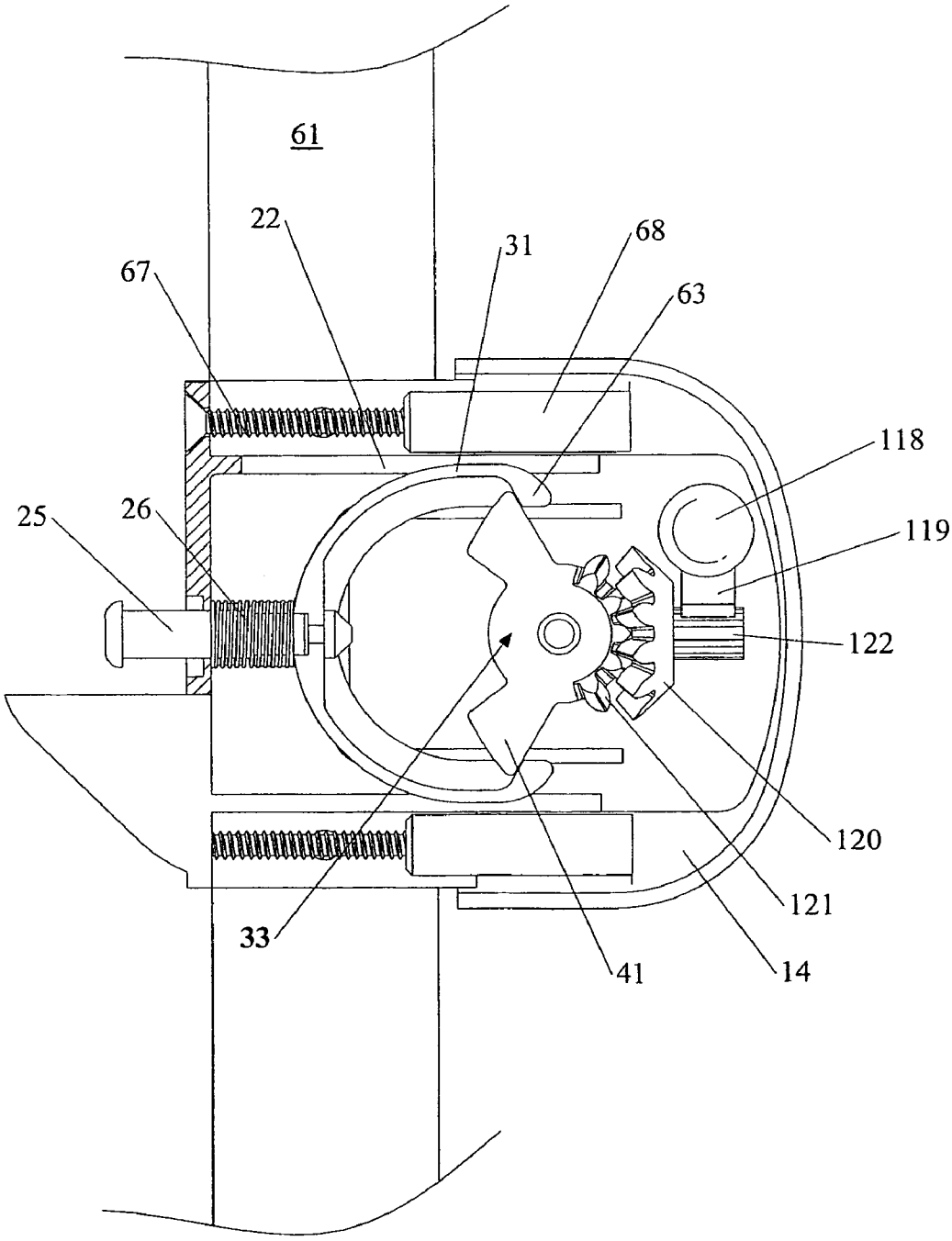
FIG. 21 is a view of the embodiment of FIG. 20 when the actuator is released and the gate-closing position has been achieved and the latch pin magnetically displaced to a latching portion.

Referring now to the seventh embodiment of FIGS. 20 and 21, like reference numerals have been used for like parts. This embodiment differs from the first embodiment by responding to rectilinear push-button operation which rotates a modified barrel 33 which otherwise functions as in the first embodiment.

Push button 118 has a gear rack 119 engaging a pinion 122 having a horizontal axis aligned with the axis of the latch pin 25. The button 118 is slidably mounted in the housing of the device and is biased by a spring (not shown) to its outward or projecting position. When the button is depressed, rack 119 rotates pinion 122 which carries a crown gear 120 in constant mesh with a gear 121 on the barrel 33 so that the barrel rotates. Upper ear 41 engages the upper lobe 63 of the carriage 31 to retract it and the latch pin 25 to the position shown in FIG. 20.

After opening of the gate on which the device is mounted, and upon release of the button, the barrel and button return to an initial position, corresponding to that shown in FIG. 21, but with the carriage 31 and latch pins remaining in the displaced position shown in FIG. 20.

When the gate is re-positioned to its closing position, the magnet in the receiving unit (not shown) attracts the latch pin to the latching position shown in FIG. 21.

We claim:

1. A self-latching device for latching, in a predetermined position, two members which are otherwise moveable relative to one another, the device comprising:

(a) a latch arm having a housing with a mounting for displaceably mounting the latch arm on a first of the two members, the latch arm being displaceable along a path through the housing, the latch arm having a latch portion mounted to extend from the housing when in a latching position;

(b) a retaining element adapted to be mounted on the second of the two members and providing a latching shoulder for engagement with the latch portion of the latch arm to prevent relative movement of the members from the predetermined position;

(c) at least one of the latch arm and the retaining element providing a magnetic field and the other having magnetic properties arranged to cause latching engagement of the latch arm with the latching shoulder under the influence of the magnetic field when the members are in the predetermined position, whereby relative movement of the two members is substantially prevented but the latch arm is displaceable under applied force away from the retaining element to a retracted position so that the members may be moved apart;

(d) a resilient biasing element associated with the latch arm to bias it towards the retracted position, but with a biasing force on the latch arm which is less than the force imparted on the latch arm by the magnetic field when the members are located in the predetermined position;

(e) an actuator movably mounted on the housing and extending from the housing transversely to the path of displacement of the latch portion for receiving a displacement force to displace the latch arm from its latching position to its retracted position, whereby the two members may be moved apart away from the predetermined position;

(f) a connector for connecting the actuator and the latch arm to transmit the displacement force from the actuator to the latch arm so that it can be displaced from its latching position to its retracted position and for leaving the actuator free to move relative to the connector upon removal of the displacement force; and (g) a second biasing element for returning the actuator to its initial position on removal of the displacement force leaving the biasing element to maintain the latch arm and connector substantially in its retracted position, whereby when in the predetermined position the latch arm is displaceable under the magnetic forces against the biasing means to re-establish its latching position; and (h) wherein the connector comprises a carriage with spaced guides for sliding along tracks in the housing, the latch arm is in the form of an elongate pin and the biasing element is in the form of a helical compression biasing spring mounted around the pin.

2. A device as claimed in claim 1, wherein the actuator is rotatably mounted in the housing and the latch arm is mounted for reciprocation in the housing.

3. A device as claimed in claim 2, wherein the lockable rotatable handle mounted on the actuator is provided to each side of the housing for manual application of force to unlatch the device.

4. A device as claimed in claim 3, wherein each lockable rotatable handle has a lever for manual application of force.

5. A device as claimed in claim 1 wherein the carriage is in the form of a generally C-shaped carriage having a lobe near at least one of its open ends for engagement with a corresponding ear element associated with a barrel of the actuator for displacement of the carriage responsive to rotation of the barrel, whereby the carriage may be displaced along the housing and the actuator returned to its initial position.

6. A device as claimed in claim 1, and wherein the magnetic field is provided by a permanent magnet having a remanence (residual flux density) of about 12 kilogauss and the latch arm has a pin having magnetic properties and of transverse dimension of about 8 mm.

7. A self-latching device for latching, in a predetermined position, two members which are otherwise moveable relative to one another, the device comprising:

(a) a latch arm;

(b) a retaining element which in use provides a latching shoulder for the latch arm to prevent relative movement of the members;

(c) at least one of the latch arm and the retaining element providing a magnetic field and the other having magnetic properties;

(d) the latch arm being adapted to be displaceably mounted on a first of said members and the retaining element being adapted to be associated with the second of said members, whereby the latch arm and retaining element have relative movement into a latching position under the influence of the magnetic field when the members are in the predetermined position to prevent relative movement of the two members by an engagement portion of the latch arm and latching shoulder interengaging;

(e) the latch arm having an associated element for receiving a retraction force to displace the latch arm away from the retaining element to a retracted position so that the members may be moved apart, (f) a first spring element arranged to bias the latch arm into the retracted position, while imparting a force on the latch arm which is less than the force imparted on the latch arm by the magnetic field when the members are located in the predetermined position, (g) a rotary actuator adapted to be mounted on the first of the members in association with the latch arm and adapted to respond to an actuating input to apply retraction force to the associated element of the latch arm to displace the latch arm from its latching position to its retracted position, whereby the two members may be moved apart away from the predetermined position, (h) a second spring element for returning the rotary actuator to its initial position on removal of the actuating input leaving the first spring element to maintain the latch arm substantially in its retracted position, whereby when the latch arm is in the predetermined position it is displaceable under the magnetic forces against the biasing means to re-establish its latching position;

(i) a housing with a mounting for mounting the latch arm for reciprocation in the housing and mounting the rotary actuator which extends from the housing for receiving the actuating input; and (j) wherein the latch arm has an associated carriage with spaced guides for sliding along tracks in the housing, the latch arm being in the form of an elongate pin and the first spring element being in the form of a helical compression biasing spring mounted around the pin.

8. A device as claimed in claim 7, wherein the carriage is in the form of a generally C-shaped carriage which has lobes near its open ends and the actuator for engagement comprises a rotatable barrel with ear elements configured for an ear element to engage a lobe upon rotation of the actuator.

9. A device as claimed in claim 8, and wherein the magnetic field is provided by a permanent magnet having a remanence (residual flux density) of about 12 kilogauss and the latch arm has a pin having magnetic properties and of transverse dimension of about 8 mm.

10. A self-latching device for latching, in a predetermined position, two members which are otherwise moveable relative to one another, the device comprising:

(a) latch arm;

(b) a retaining element which in use provides a latching shoulder for the latch arm to prevent relative movement of the members;

(c) at least one of the latch arm and the retaining element providing a magnetic field and the other having magnetic properties;

(d) the latch arm being adapted to be displaceably mounted on a first of said members and the retaining element being adapted to be associated with the second of said members, whereby the latch arm and retaining element have relative movement into a latching position under the influence of the magnetic field when the members are in the predetermined position to prevent relative movement of the two members by an engagement portion of the latch arm and latching shoulder interengaging;

(e) the latch arm having an associated element for receiving a retraction force to displace the latch arm away from the retaining element to a retracted position so that the members may be moved apart, (f) a first spring element arranged to bias the latch arm into the retracted position, while imparting a force on the latch arm which is less than the force imparted on the latch arm by the magnetic field when the members are located in the predetermined position, (g) a rotary actuator adapted to be mounted on the first of the members in association with the latch arm and adapted to respond to an actuating input to apply retraction force to the associated element of the latch arm to displace the latch arm from its latching position to its retracted position, whereby the two members may be moved apart away from the predetermined position, (h) a second spring element for returning the rotary actuator to its initial position on removal of the actuating input leaving the first spring element to maintain the latch arm substantially in its retracted position, whereby when the latch arm is in the predetermined position it is displaceable under the magnetic forces against the biasing means to re-establish its latching position; and (i) a housing with a mounting for mounting the latch arm for reciprocation in the housing and mounting the rotary actuator which extends from the housing for receiving the actuating input, (j) wherein the rotary actuator includes a rotor adapted to be rotated in response to the actuating input, the rotor having engagement means and the device further comprises a connector mounted in the housing in association with the latch arm and having complementary engagement means arranged to be engaged by the engagement means of the rotor to displace the connector and the latch arm responsive to rotation of the rotor.

11. A device as claimed in claim 10, wherein the rotor has a barrel shaped core element, a relatively rotatable collar element, and a connection element displaceable between a retracted position and an engagement position upon actuation of a lock between a device-locked and a device-unlocked configuration such that in the unlocked configuration the connection element inter-connects the rotor and collar element to transmit rotation to displace the latch arm.

* * * * *